US006488162B1

(12) United States Patent
Carlstedt

(10) Patent No.: US 6,488,162 B1
(45) **Date of Patent: *Dec. 3, 2002**

(54) DRAFT GEAR FOR A REDUCED-SLACK DRAWBAR ASSEMBLY

(75) Inventor: Richard A. Carlstedt, Wheaton, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/910,506

(22) Filed: Jul. 19, 2001

(51) Int. Cl.[7] ..... B61G 9/00
(52) U.S. Cl. ..... 213/75 R; 213/23 R
(58) Field of Search ..... 213/36 C, 36, 213/37, 31, 38, 32 R, 34, 24

(56) References Cited

U.S. PATENT DOCUMENTS

| | | | | |
|---|---|---|---|---|
| 4,556,149 A | * | 12/1985 | Carlstedt | 213/34 |
| 4,916,794 A | * | 4/1990 | Loonam | 29/402.03 |
| 4,960,215 A | * | 10/1990 | Carlstedt | 213/32 R |
| 5,312,007 A | | 5/1994 | Kaufhold et al. | |
| 5,360,129 A | | 11/1994 | Wurzer et al. | |
| 5,452,814 A | * | 9/1995 | Merker, Jr. et al. | 213/32 C |
| 5,529,194 A | * | 6/1996 | Merker et al. | 213/32 C |
| 5,590,797 A | * | 1/1997 | Duffy et al. | 213/33 |
| 5,593,051 A | | 1/1997 | Openchoswski | |
| 5,598,937 A | | 2/1997 | Clark | |
| 5,617,965 A | | 4/1997 | Hawryszkow | |
| 6,024,233 A | | 2/2000 | Natschke et al. | |
| 6,073,787 A | | 6/2000 | Daugherty, Jr. et al. | |
| 6,199,708 B1 | | 3/2001 | Monaco | |

OTHER PUBLICATIONS

"Slack is the Enemy"—William C. Vantuono Railway Age—Oct., 2000—pp. 39–43.
"Drawbar Dilemma"—William C. Vantuono Railway Age—Mar., 2001—pp. 39–42.

* cited by examiner

*Primary Examiner*—S. Joseph Morano
*Assistant Examiner*—Frantz F. Jules
(74) *Attorney, Agent, or Firm*—John W. Harbst

(57) ABSTRACT

A draft gear which has a wedge, two friction shoes, two tapered wear liners, a spring seat and a spring package. The wedge has surfaces which cooperate with surfaces on each of the friction shoes forming a first selected angle of about 40 degrees to the major axis of the draft gear housing. A second group of surfaces on the friction shoes cooperate with surfaces on the tapered wear liners to create a second selected angle of about 5 degrees with respect to the major axis of the draft gear. A third group of surfaces on the friction shoes cooperate with surfaces on the spring seat to form a third selected angle of about 65 degrees with respect to the major axis of the draft gear.

18 Claims, 7 Drawing Sheets

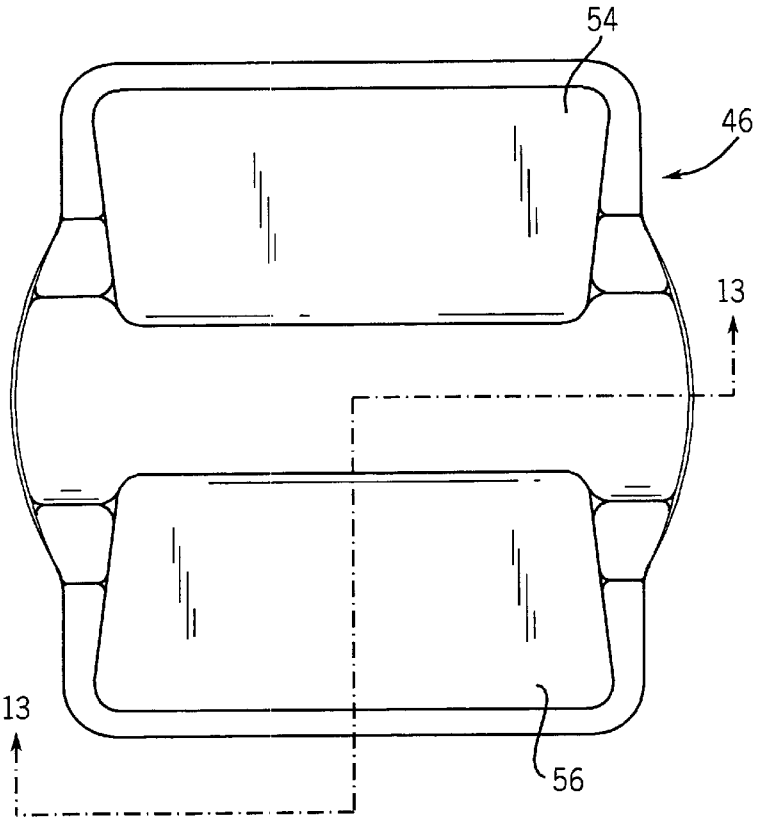
FIG. 12
FIG. 14
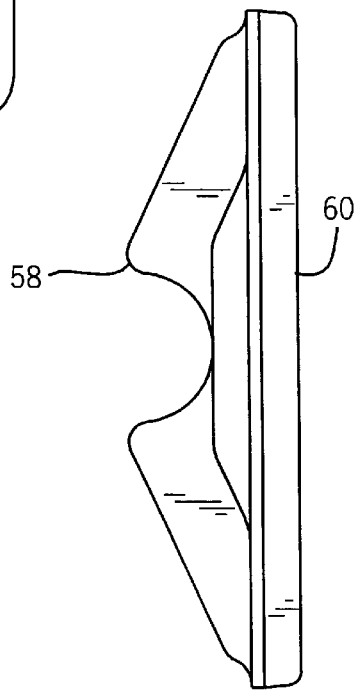
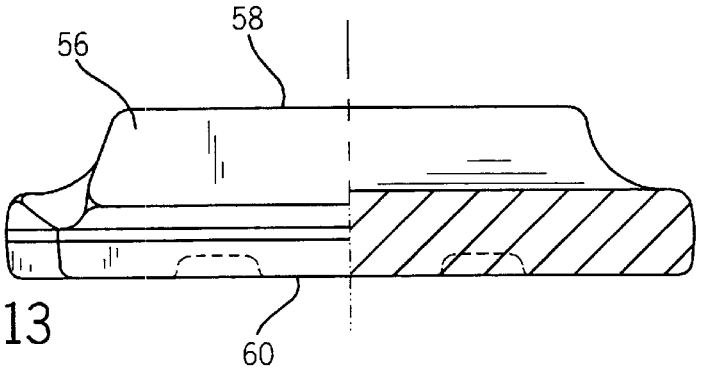
FIG. 13

DRAFT GEAR FOR A REDUCED-SLACK DRAWBAR ASSEMBLY

BACKGROUND OF THE INVENTION

1. Field of the Invention

The present invention relates to draft gears and, in particular, to an improved draft gear having a very high preload, and a very short travel for the absorption and dissipation of input forces.

2. Prior Art

Reduced-slack assemblies or systems typically include a device to cushion and absorb forces placed on the system during car operation. The cushioning and absorption of forces is always done in the buff direction and sometimes in the draft direction as well. While such devices have acceptable absorption capacities, they are often lacking in mechanisms which protect the device against over-solid conditions.

SUMMARY OF THE INVENTION

The present invention overcomes the disabilities of the prior art by providing a a draft gear having a very high preload, limited axial travel, high energy absorption in both buff and draft directions and spring package protection in over-solid situations.

In accordance with general draft gear design, the present invention includes a housing with a closed end and an open opposite end which is provided with an internal pocket area wherein are located tapered wear liners. A wedge is mounted for axial movement in the open end of the housing and is situated for direct application of draft or buff forces. Friction devices are positioned within the housing, between the wedge and the wear liners, to absorb through friction some of the energy created by the application of a force to the wedge. A spring seat is positioned between the friction devices and a spring package which can be either an elastomeric pad stack or steel spring group.

The friction devices of the draft gear design include two opposed friction shoes, each having a first flat angled surface or face in sliding engagement with a corresponding flat, angled surface or face on the wedge. The angled surface of each friction shoe and the corresponding angled surface on the wedge form a first selected angle with respect to the major axis of the draft gear housing. In a preferred form, each friction shoe also has a second flat, angled surface or face in engagement with one of two tapered wear liners, located in and at opposite sides of the open end of the draft gear housing whereby forming a second selected angle with respect to the major axis of the draft gear housing. In a preferred form, each friction shoe also has a third flat, angled surface or face in engagement with a flat angled face or surface formed on the spring seat. The individual third flat angled face of the shoe and the individual flat angled face on the spring seat form a third selected angle with respect to the major axis of the draft gear housing.

In the preferred embodiment of the invention, the first selected angle of the adjoining surfaces of the friction shoe and the wedge is about 40 degrees, plus or minus about 3 degrees, but as much as 5 degrees. The second selected angle of the adjoining surfaces of the friction shoe and the wear liner surface is about 5 degrees, plus about 3 degrees and minus about 2 degrees. The third selected angle of the adjoining surfaces of the friction shoe and the flat face formed in the spring seat is about 65 degrees, plus or minus about 3 degrees. As is appreciated, all of these angles are measured with respect to the major axis of the housing. An elastomeric pad stack comprises a plurality of concentric elastomeric springs which are made in accordance with U.S. Pat. Nos. 4,566,678 and 5,351,844, which are incorporated by reference herein, may be employed to absorb additional energy. A spring package comprising steel springs can also be employed as an alternative to the elastomeric pad stack.

Thus, an object of this invention is the provision of a draft gear for a reduced-slack drawbar assembly which fits in a standard pocket and has no more than about 25 mm of travel.

Another object of this invention is the provision of a draft gear for a reduced-slack drawbar assembly which absorbs energy in both the buff and draft directions and has a metal shell to protect the spring package, whether an elastomeric package or a steel spring group, in the over-solid condition.

An additional object of this invention is the provision of a draft gear for a reduced-slack drawbar assembly which includes a housing and a spring package that is subjected to a preload of about 30,000 lbs. to about 50,000 lbs., depending on whether steel coil springs or elastomeric pads are employed.

DESCRIPTION OF THE DRAWINGS

Other features and advantages of the invention will become apparent in the following description of the preferred embodiment taken in conjunction with the drawings, in which:

FIG. 12 is an outside elevational view of a spring seat forming part of the draft gear illustrated in FIG. 1;

FIG. 13 is a cross sectional view of the spring seat as seen generally along line 13—13 of FIG. 12;

FIG. 14 is a side elevational view of the spring seat of FIG. 12;

DESCRIPTION OF THE PREFERRED EMBODIMENT

Figure 2:
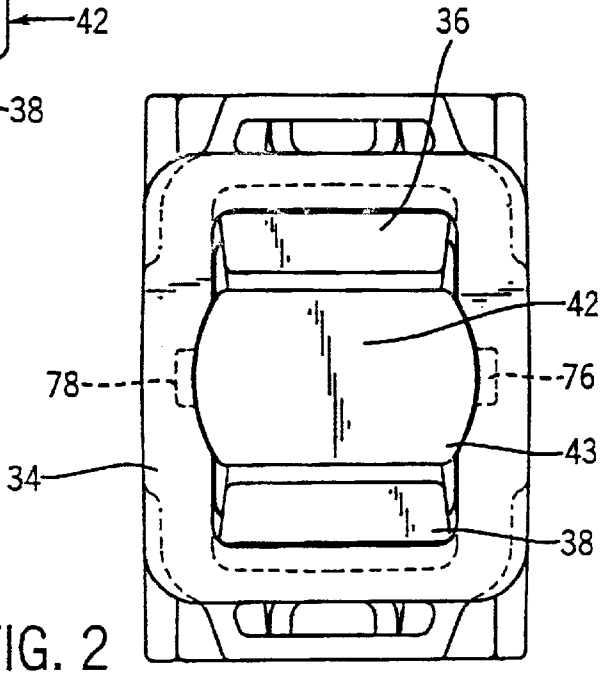
FIG. 2 is a end view of the draft gear of FIG. 1.
Figure 1:
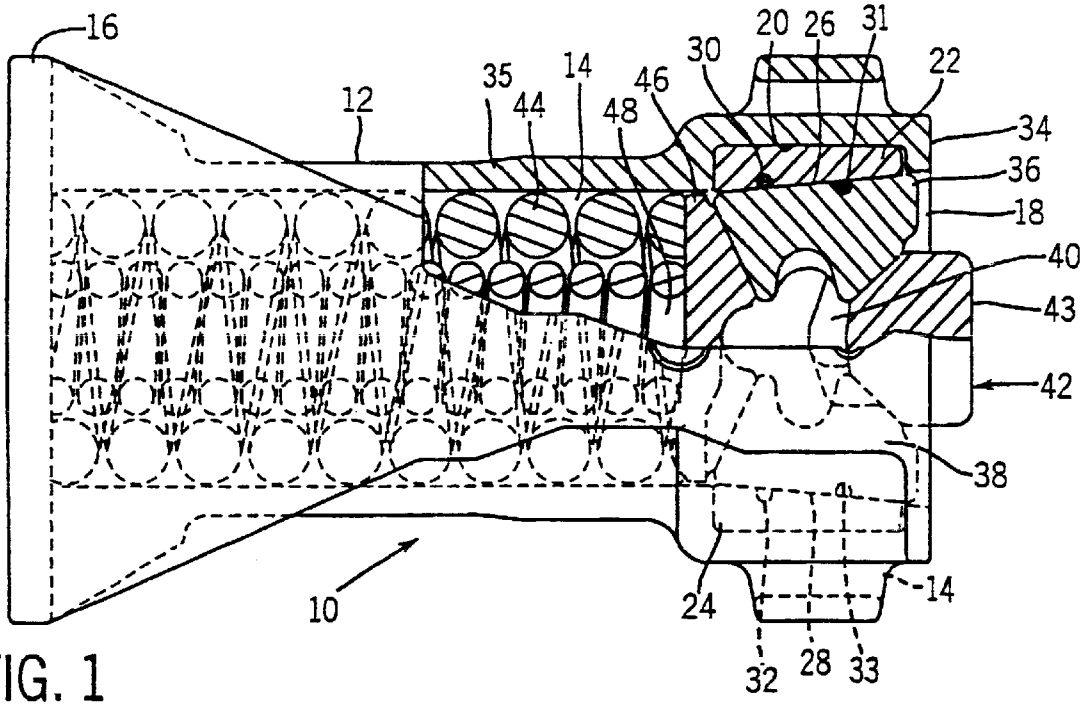
FIG. 1 is a side view of one form of a draft gear embodying features of the present invention and shown in partial cross-section to illustrate various details of construction.
Figure 15:
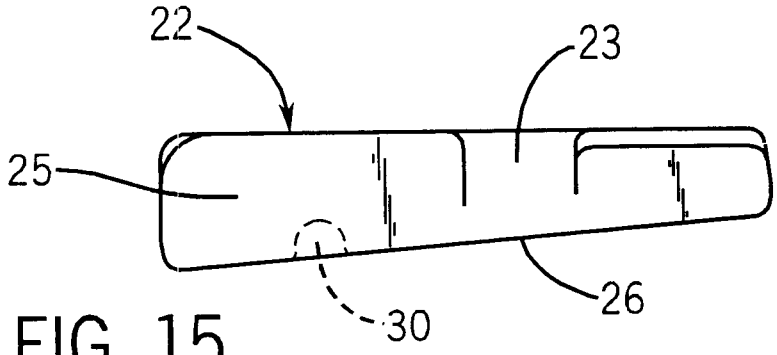
FIG. 15 is a side elevational view of a wear liner forming part of the draft gear illustrated in FIG. 1.
Figure 16:
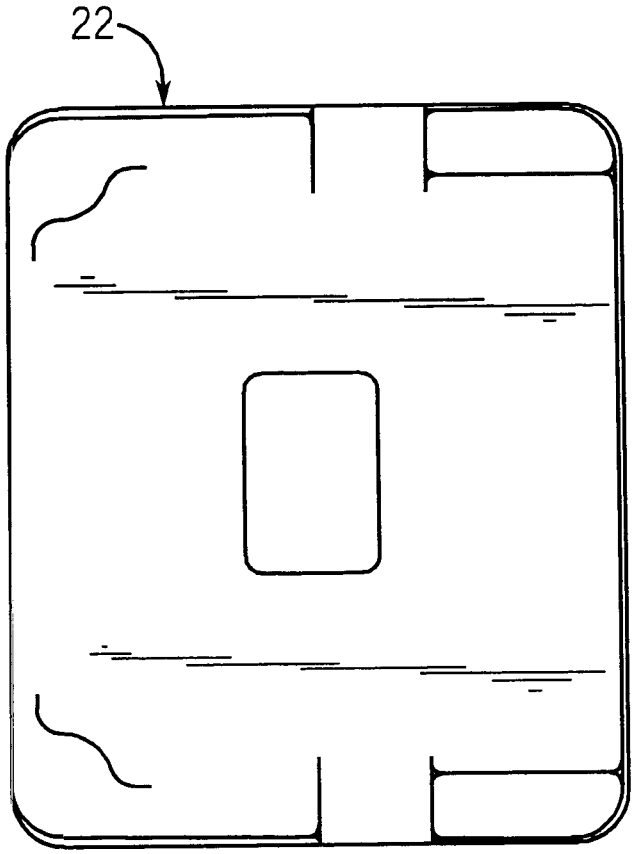
FIG. 16 is an outside elevational view of the wear liner of FIG. 15.

As illustrated in the drawings, a draft gear 10 for a reduced-slack drawbar assembly seen in FIG.1 includes a housing 12 having an axial bore 14 with one end thereof being closed by a fixed end wall or plate 16. The housing 12 is provided with an opposite open end 18 which includes an internal pocket area 20 wherein are located first and second tapered wear liners 22 and 24. The two wear liners 22 and 24 each have tapered friction surfaces 26 and 28, wherein is carried at least one lubrication insert 30 and 32. Reference to FIGS. 15 and 16 will provide more information about the liners 22 and 24.

The open end 18 carries through the generally box-shaped bore 14 with side pockets 20, all of which terminate at an end surface 34 defined by the hollow housing 12. The open end 18 and the fixed end wall 16 are integrally interconnected by a transition wall section 35 which serves to bind the two together both internally and externally.

Friction devices, such as first and second friction shoes 36 and 38, are placed opposite each other, as shown in FIG. 1, in sliding friction producing engagement with the wear liners 22 and 24. The friction shoes 36 and 38 are assembled as shown in FIG. 1 whereby defining an outwardly opening pocket for receiving the tapered end 40 of the wedge 42.

Figure 3:
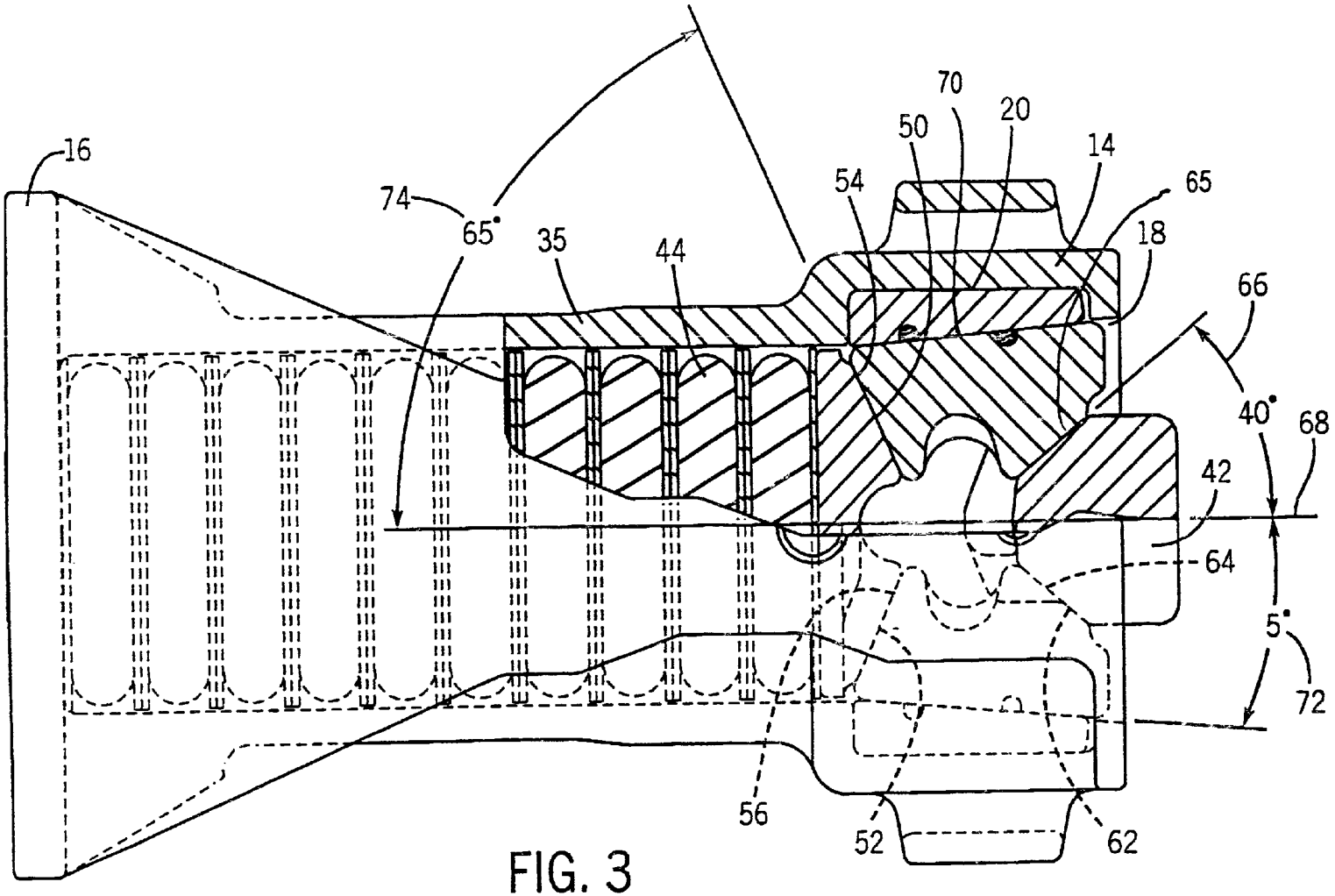
FIG. 3 is a side view of another form of draft gear similar to FIG. 1 but having an elastomeric spring package rather than a steel spring package, and illustrating various selected angles for component parts comprising the draft gear.
Figure 4:
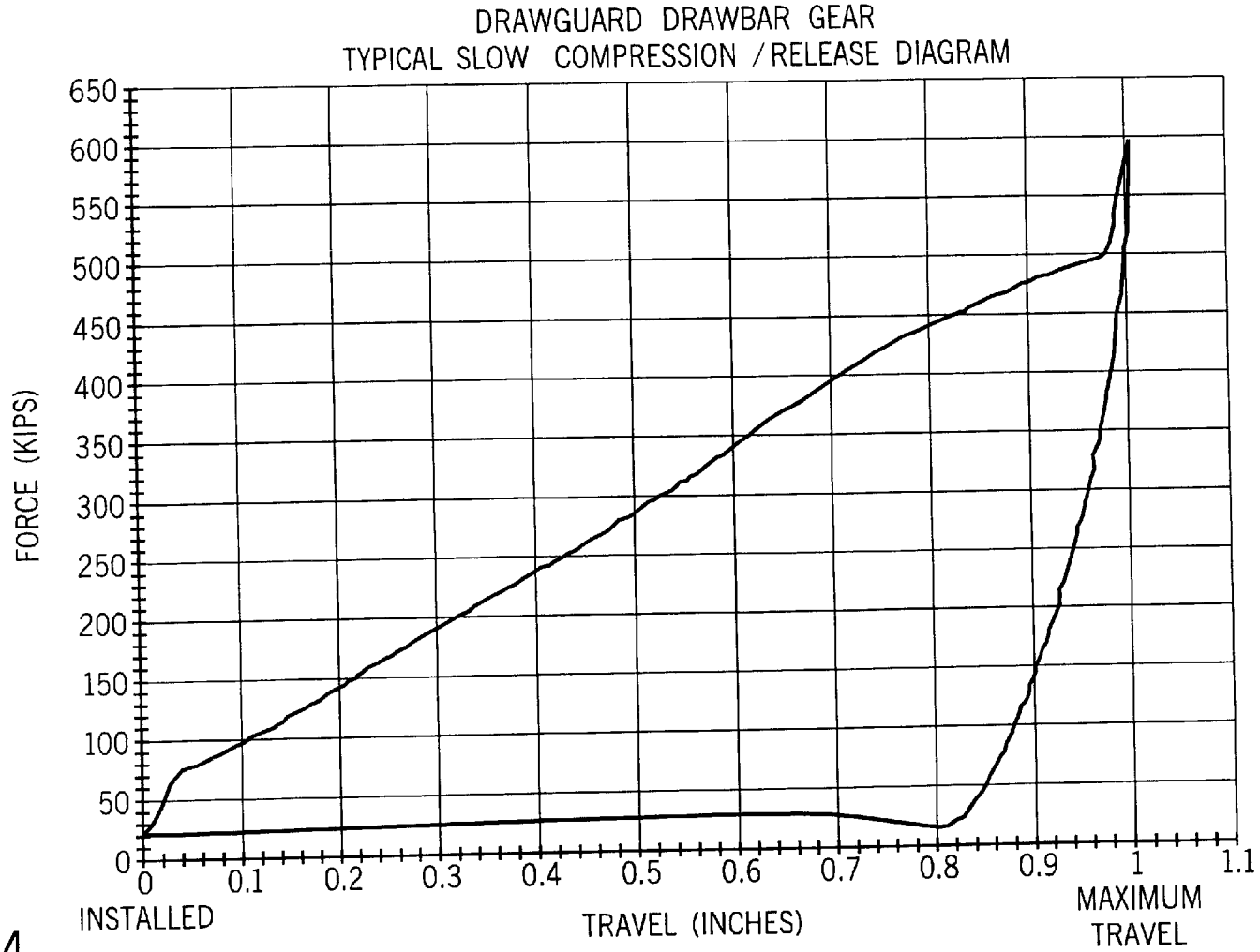
FIG. 4 is a typical force/travel curve of the draft gear which is the subject of this invention.
Figure 5:
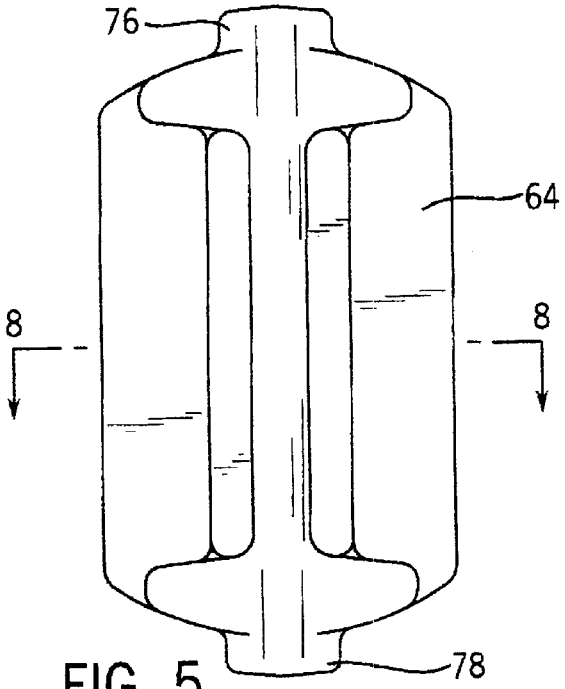
FIG. 5 is an elevational view of a wedge forming part of the draft gear illustrated in FIG. 1, viewed from the left side of the page.
Figure 6:
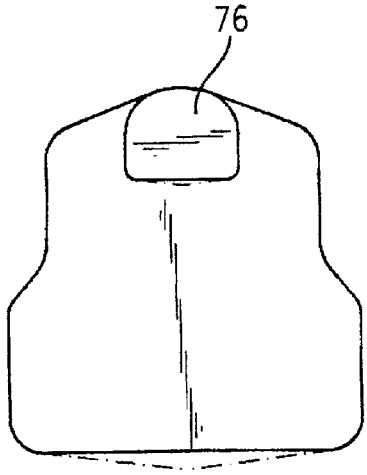
FIG. 6 is an end view of the wedge of FIG. 5.

A spring package 44 is provided in the hollow housing 12 between the closed end of housing 12 and extends longitudinally within the wall section 35 of housing 12 and presses against one side of a spring seat 46, which, as illustrated in FIGS. 1 and 3 extends generally normal to the major axis of housing 12. As shown in FIGS. 1 and 3, the resiliently biased spring seat 46 presses against and coacts with the end portion of the shoes 36 and 38 opposite the wedge 24. The purpose of the spring package 44 is to store energy generated during compression of the draft gear 10. Moreover, the spring package 44 maintains the wedge 42, the friction shoes 36 and 38, the wear liners 22 and 24, and the spring set 46, in operative engagement with each other and within the housing 12, both during the operation of the draft gear, as well as during periods of non-operation. As is known in the art, the spring package 44 can take different forms without detracting or departing from the spirit and scope of the present invention, That is, in one form, schematically illustrated in FIG. 1, the spring package 44 comprises a spring group including one or more steel springs. In another form, schematically illustrated in FIG. 3, the spring package 44 comprises an elastomeric pad stack of a type well known in the art. In addition to the resistance developed at the open end 18 of the housing 12 during lateral outward movement of the friction shoes 36 and 38 against the housing 12 resulting from axial compression of the wedge 42 and the spring seat 46, relative to each other, the spring package 44 furthermore adds resistance to axial compression of the draft gear 10. As shown in FIG. 4, the spring package 44 has a preload of about 26,000 lbs., and after about only 0.98 inches (25 mm) of compression, the spring package 44 generates a resistence of about 500 KIPS. Maximum compression of the draft gear 10 is about one inch (25 mm) at which point the outer surface or free end 43 of the wedge 42 is substantially flush with the end surface 34 of the housing 12. Further, it should be noted that at only about 0.025 inches of travel, the resistence of the draft gear 10 has already increased to about 75 KIPS. As is conventional, a follower plate (not shown) is normally placed against the free end 43 of the wedge 42 and through it the draft gear 10 is compressed. During operation of the draft gear 10, and in the event a very large force, i.e., a force sufficient to compress the spring package 44 beyond its limits, is exerted against the follower plate, the wedge 42 moves to the left, as seen in FIGS. 1 and 3, for a distance of about one inch (25 mm), at which point the follower plate bottoms out on or abuts against the end surface 34 of housing 12 which exists or acts as a positive stop whereby preventing further compression of the draft gear 10 in either buff or draft. As a result, and as will be appreciated from an understanding of the present invention, the spring package 44 is not exposed to an unlimited application of input force in either buff or draft. Additionally, the existence of the preload on the spring package 44, allows the draft gear 10 to normally assume its full operative length, as shown in FIG. 1, when arranged in combination with a rail car (not shown), after the gag is removed, thus, allowing the draft gear 10 to create an effective load on the draft lugs so as to substantially eliminate slack in the yoke and gear assembly.

The spring seat 46 is disposed between the outward end 48 of the spring package 44 and the third flat angled faces 50 and 52 of the friction shoes 36 and 38 and is adapted for longitudinal movement in the housing 12 to compress the spring package 44, when force is applied to the wedge 42. As shown in FIGS. 12–14, the spring seat 46 includes first, and second flat angled portions 54 and 56, is generally rectangular in shape and has a front 58 and a rear surface 60.

Figure 9:
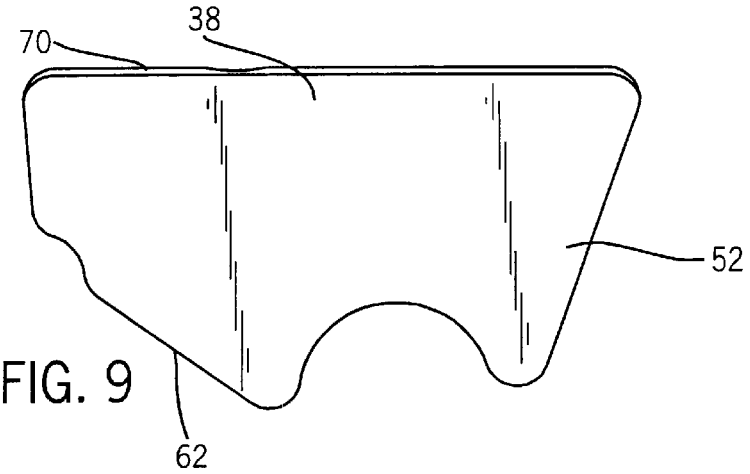
FIG. 9 is an inside elevational view of one of two friction shoes forming part of the draft gear illustrated in FIG. 1.
Figure 10:
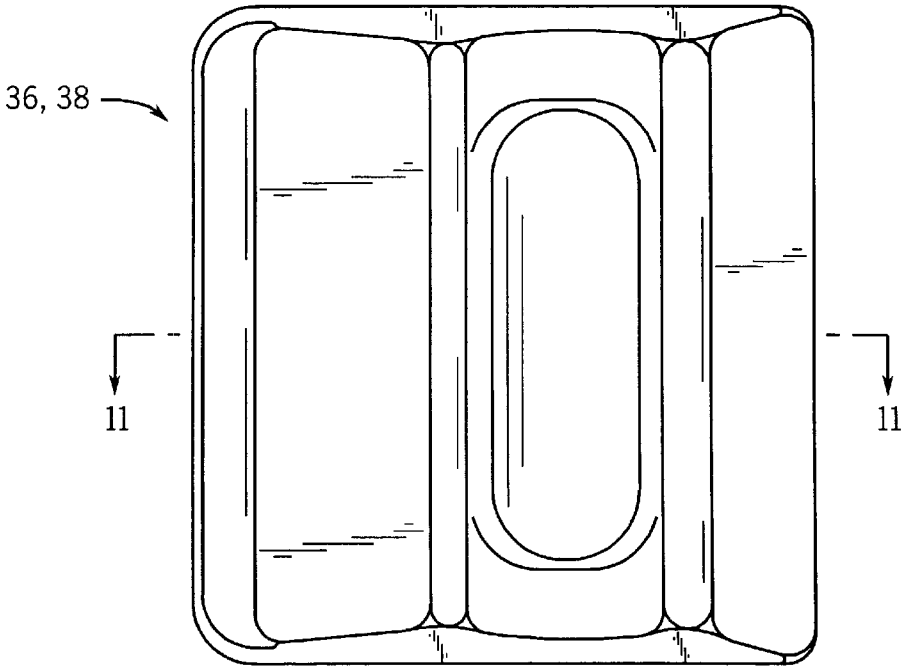
FIG. 10 is a side elevational view of the friction shoe of FIG. 9.
Figure 11:
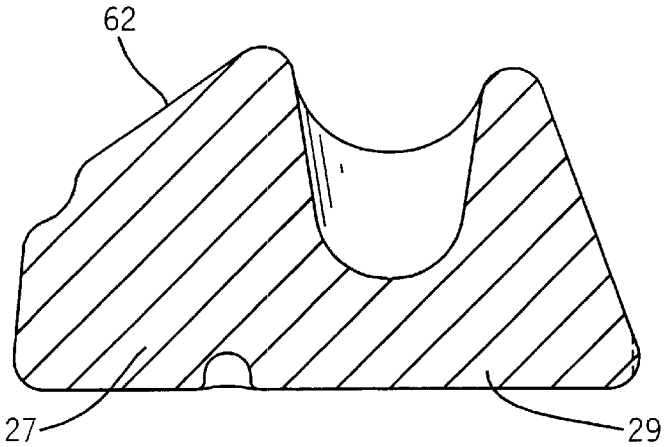
FIG. 11 is a cross sectional view of the friction shoe taken along line 11—11 of FIG. 10.

Each of the two friction shoes 36 and 38 are the same in size, shape and function and, thus, discussion will be limited to friction shoe 38 as shown in FIGS. 9–11 with the understanding that it applies as well to friction shoe 36. The friction shoe 38 has a first, preferably flat or planar and preferably elongated inner angled surface 62 (FIG. 9), which, when assembled within the draft gear 10, is arranged in sliding engagement with a corresponding or matching and preferably flat or planar angled outer surface 64 defined by wedge 42. As shown in FIG. 3, these two surfaces 62 and 64 are each correspondingly disposed at a first selected angle 66 with respect to the major axis 68 of the housing 12. The friction shoe 38 also has a preferably flat elongated outer surface 70 (FIG. 9) extending between opposed end portions of the shoe 38 and which, when shoe 38 is operatively disposed in combination with housing 12, is in engagement with one of the corresponding or matching tapered inner friction surfaces 26 or 28 arranged toward the open end of the housing 12 and preferably provided by either of the two tapered wear liners 22 or 24. As shown in FIG. 3, the inner surface 26, 28 on the liners 22, 24, respectively, along with correspondingly disposed or matching outer angled surface 70 on the frictions shoes 26, 28 form a second selected angle 72 with respect to the major axis 68 of housing 12. Furthermore, the friction shoe 38 has a third preferably flat, angled and preferably elongated surface 50 (FIG. 3) arranged toward the end of the shoe 38 opposite from inner angled surface 62. As shown in FIG. 3, when the draft gear 10 is assembled, inner angled face 50 on the friction shoe 38 is arranged in sliding engagement with one of the correspondingly angled surfaces 54 or 56 of the spring seat 46 whereby forming a third selected angle 74 with respect o the major axis 68 of the housing 12.

Figure 7:
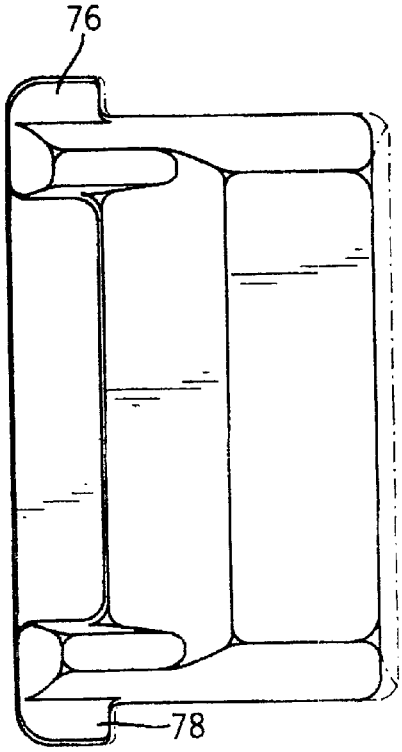
FIG. 7 is a side view of the wedge of FIG. 5.
Figure 8:
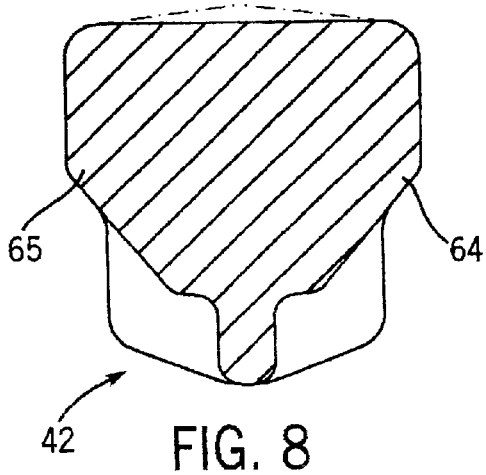
FIG. 8 is a cross sectional view as seen generally along line 8—8 of FIG. 5.

As illustrated in FIGS. 3 and 8, the wedge 42 has first and second angled outer surfaces 64 and 65 which are the same in size, shape and function and, thus, discussion is limited to one thereof To retain the wedge 42 and the frictions shoes 36 and 38 in the open end 18 of the housing 12, the wedge 42 is provided with two outwardly projecting flanges 76 and 78 (FIG. 7). During assembly of the draft gear 10, the wedge flanges 76 and 78 are positively retained in assembled relationship in the housing 12 due also in part to the forces generated by the preload to which the spring package 44 is subjected.

As previously discussed, the two tapered wear liners 22 and 24 each preferably have a lubrication insert. It is understood, both tapered wear liners 22 and 24 are the same in size, shape and function and, thus, discussion will be limited to tapered wear liner 22 as shown in FIGS. 15 and 16, with the understanding it applies as well to tapered wear liner 24. The wear liner 22 includes an outer portion 23 and an inner section 25, Preferably, the inner portion of the wear liner 22 is provided with the lubrication insert 30. The friction shoe 36, as shown in FIGS. 9 and 11, also includes an outer portion 27 and an inner portion 29, with a lubrication insert 31 being carried by the outer portion 27. Because the working stroke of the draft gear 10 according to the present invention is limited to only about one inch (25 mm), lubricating material from lubricating insert 31, in shoe 36, is preferably not distributed over the entire plane or surface of sliding engagement of between shoe 36 and wear liner 22. The addition of lubricating insert 30 in liner 22 enables lubricating insert material to be distributed over the plane or surface of sliding engagement between respective inner portions 25 and 29 of the liner 22 and shoe 36, thereby completing the spread of lubricating insert material over the whole liner and shoe sliding engagement plane or surface whereby promoting sliding movement therebetween.

While embodiments of this invention have been shown and described, it should be understood that this invention is not limited hereto except by the scope of the claims. Various modifications and changes may be made without departing from the scope and spirit of the invention as the same will be understood by those skilled in the art.

I claim:

1. A draft gear for use in a reduced slack drawbar system, said draft gear comprising:

a hollow housing open at a first end and closed toward a second end, said housing defining a major axis and having a tapered opening toward a front portion arranged adjacent the first end of said housing;

a friction member assembly consisting of two laterally spaced friction members, with each friction member including a first end portion having a first angled surface and a second end portion having a second angled surface and an outer angled surface between said first and second end portions, with the angle of the outer surface of each friction member substantially corresponding to an angle of an inner surface of the tapered opening provided by said housing whereby defining a first sliding surface therebetween, with said first sliding surface between the outer angled surface of each friction member and the inner surface of the tapered opening on said housing defining an angle of about 5 degrees, plus 3 degrees and minus 2 degrees, relative to the major axis of said housing;

a wedge arranged for axial movement relative the open end of said housing, said wedge having a free end axially extending about one inch beyond the open end of said housing when said draft gear is at a full operative length and against which an external force can be applied, said wedge further defining an outer tapered portion spaced axially inward from the free end of said wedge, with the outer tapered portion of said wedge substantially corresponding to the first angled surface at the first end portion of each friction member whereby defining a second sliding surface therebetween, with the second sliding surface defined between the outer tapered portion on said wedge and the first angled surface of each friction member defining an angle of about 40 degrees, plus or minus 5 degrees, relative to the major axis of said housing;

a spring seat arranged within and at a generally normal disposition relative to the major axis of said housing, said spring seat defining on one side thereof an angled surface configured to substantially correspond to the second angled surface at the second end portion of each friction member whereby a third sliding surface is defined therebetween, with said third sliding surface defined between the angled surface on said spring seat and the second angled surface at the second end portion of each friction member defining an angle of about 65 degrees, plus or minus 5 degrees, relative to the major axis of said housing;

a spring package disposed within said hollow housing between the closed end of said housing and a side of said spring seat opposed to said one side for storing energy generated during compression of said draft gear; and wherein said draft gear is provided with a substantially slackless design which limits compression of the full operative length of said draft gear to about one inch while the configuration of the housing and the wedge along with the angularity of the first, second and third sliding surfaces relative to the major axis of said housing in cooperation with said spring package offer a resisting force of about 600 KIPS after the free end of said wedge axially moves toward the free end of said housing about one inch.

2. The draft gear according to claim 1 wherein said first sliding surface between the outer surface of each friction member and the inner surface of the tapered opening on said housing defines an angle of 5 degrees relative to the major axis of said housing; and, wherein said second sliding surface defined between the outer tapered portion on said wedge and the first surface of each friction member defines an angle of 40 degrees relative to the major axis of said housing; and, wherein said third sliding surface defined between the angled surface on said spring seat and the second surface at the second end portion of each friction member defines an angle of 65 degrees relative to the major axis of said housing.

3. The draft gear according to claim 1 wherein both the inner tapered surface of the tapered opening on said housing and the outer surface of each friction member angle laterally inwardly toward the major axis of said housing at an angle of 5 degrees.

4. The draft gear according to claim 1 wherein both the outer tapered portion on said wedge and the first angled surface of each friction member angle laterally inwardly toward the major axis of said housing at an angle of 40 degrees.

5. The draft gear according to claim 1 wherein both the angled surface on said spring seat and the second angled surface at the second end portion of each friction member angle away from the major axis of said housing at an angle of 65 degrees.

6. The draft gear according to claim 1 wherein each friction member is provided with a lubricating insert to provide at least a portion of said sliding surface cooperatively defined between the outer surface of each friction member and the inner surface of the tapered opening on said housing with lubrication for promoting sliding movement between the outer tapered surface of each friction member and the inner surface of the tapered opening on said housing.

7. The draft gear according to claim 1 further including a pair of wear liners arranged in operable combination with said housing, with each liner having a tapered inner surface which, when said liners are arranged in said housing, define said tapered opening toward the front portion and adjacent the first end of said housing.

8. The draft gear according to claim 7 wherein each wear liner is provided with a lubricating insert to provide at least a portion of said sliding surface cooperatively defined between the outer surface of each friction member and the inner surface of the tapered opening on said housing with lubrication for promoting sliding movement between the outer tapered surface of each friction member and the inner surface of the tapered opening on said housing.

9. A draft gear for use in a reduced slack drawbar system, said draft gear comprising:

a hollow housing open at a first end and closed toward a second end, said housing defining a major axis and having a tapered opening toward a front portion arranged adjacent the first end of said housing;

a friction shoe assembly consisting of two friction shoes arranged on opposite sides of said major axis for limited lateral movement relative to the major axis of said housing, with each friction shoe including a first end portion with a first inner angled surface and a second end portion with a second inner angled surface and an outer angled surface between said first and second end portions, with said outer angled surface of each friction shoe being engagable with a respective laterally opposed inner surface of the tapered opening provided by said housing, and wherein said outer angled surface for each friction shoe and the laterally opposed inner surface of the tapered opening provided by said housing each being disposed in a plane defining an angle of about 5 degrees, plus 3 degrees and minus 2 degrees, relative to the major axis of said housing;

a wedge arranged for axial movement relative the open end of said housing, said wedge having a free end extending outwardly beyond the first end of said housing a distance of about one inch when said draft gear is at a full operative length and against which an external force can be applied, said wedge defining outer tapered portions spaced axially inward from the free end of said wedge, with one outer tapered portion on said wedge engaging and sliding along the first inner angled surface of each friction shoe, and wherein the outer tapered portions on the wedge and the first inner angled surface of each friction shoe each being disposed in a plane defining an angle of about 40 degrees, plus or minus 5 degrees, relative to the major axis of said housing;

a spring seat arranged within and at a generally normal disposition relative to the major axis of said housing, said spring seat defining on one side thereof angled surfaces, with one angled surface on said spring seat engaging and sliding along the second inner angled surface on each friction shoe, and wherein the angled surfaces on said spring seat along with the second angled surface on each friction shoe each being disposed in a plane defining an angle of about 65 degrees, plus or minus 3 degrees, relative to the major axis of said housing;

a spring package within said hollow housing between the closed end of said housing and a side of the spring seat opposed to said one side whereby said spring package stores energy ap-applied to said wedge during compression of said draft gear from said full operative length, with said spring package being compressed from a preload of at least 25,000 pounds; and wherein said draft gear is provided with a controlled slack design which limits axial compression of the full operative length of said draft gear to one inch while the friction shoe angled surfaces combine with the said housing, said wedge, and said spring seat to offer cushioning of impact forces up to 600 KIPS in response to said draft gear being compressed, in either buff or draft, about one inch from the full operative length thereof.

10. The draft gear according to claim 9 wherein said sliding surface between the outer angled surface of each friction shoe and the inner angled surface of the tapered opening on said housing defines an angle of 5 degrees relative to the major axis of said housing; and, wherein the sliding surface defined between the outer tapered portion on said wedge and the first surface of each friction shoe defines an angle of 40 degrees relative to the major axis of said housing; and, wherein said another sliding surface defined between the angled surface on said spring seat and the second surface at the second end portion of each friction member defines an angle of 65 degrees relative to the major axis of said housing.

11. The draft gear according to claim 10 wherein the outer surface between said first and second end portions of each shoe has a generally planar configuration.

12. The draft gear according to claim 10 wherein both the inner tapered surface of the tapered opening on said housing and the outer surface of each friction shoe angle laterally toward the major axis of said housing at an angle of 5 degrees.

13. The draft gear according to claim 12 further including a pair of wear liners arranged in operable combination with said housing, with each liner having a tapered inner surface which, when said liners are arranged in said housing, define said tapered opening toward the front portion and adjacent the first end of said housing.

14. The draft gear according to claim 13 wherein the tapered inner surface of each wear liner is lubricated for promoting sliding movement between the outer tapered surface of each friction shoe and the inner surface of the tapered opening on said housing.

15. The draft gear according to claim 10 wherein both the outer tapered portion on said wedge and the first angled surface of each friction shoe angle laterally toward the major axis of said housing at an angle of 40 degrees.

16. The draft gear according to claim 10 wherein both the angled surface on said spring seat and the second angled surface at the second end portion of each friction member angle away from the major axis of said housing at an angle of 65 degrees.

17. The draft gear according to claim 10 wherein the outer tapered surface of each shoe is lubricated for promoting sliding movement between the outer tapered surface of each friction shoe and the inner surface of the tapered opening on said housing.

18. A draft gear for use in a reduced slack drawbar system, said draft gear comprising:

a hollow housing open at a first end and closed toward a second end, said housing defining a major axis and having a tapered opening toward a front portion arranged adjacent the first end of said housing, and wherein the first and second ends of said housing define generally parallel surfaces with a predetermined length therebetween;

first and second friction shoes arranged on opposite sides of said major axis for limited lateral movement relative to the major axis of said housing, with each friction shoe including a first end portion with a first angled surface and a second end portion with a second angled surface and an outer surface between said first and second end portions, with said outer surface for each friction shoe and the inner surface of the tapered opening provided by said housing being disposed in substantially matching relation relative to each other and with each of said outer surface for each friction shoe and the inner surface of the tapered opening provided by said housing forming an acute angle greater than 3 degrees but less than 8 degrees relative to the major axis of said housing;

a wedge arranged for axial movement relative the open end of said housing, said wedge having a free end extending outwardly beyond the first end of said housing a distance of about one inch when said draft gear is at a full operative length and against which an external force can be applied, said wedge defining an outer tapered portion which combines with said first inner angled surface on each friction shoe to laterally urge said shoes laterally outward relative to the major axis of said housing upon compression of said draft gear;

a spring seat arranged within and at a generally normal disposition relative to the major axis of said housing, said spring seat defining on one side thereof an angled surface which combines with said second inner angled surface on each friction shoe to urge said shoes laterally outward relative to the major axis of said housing upon compression of said draft gear; and an axially elongated spring package within said hollow housing extending between the closed end of said housing and a side of the spring set opposed to said one side whereby said spring package stores energy applied to said wedge during compression of said draft gear from said full operative length, with said spring package being compressed from a preload of at least 25,000 pounds; and wherein the preload compression of said spring package in combination with the angled surfaces between said housing, said friction shoes, said wedge, and said spring seat are such that said draft gear provides a resisting force in excess of 50,000 lbs. when said draft gear is compressed, in either buff or draft, only about 0.062 inches from said full operative length while yielding a reduced slack draft gear design wherein said housing provides over-solid protection for said spring package after the free end of said wedge axially moves toward said housing only about one inch.

* * * * *